US006591071B2

(12) United States Patent
Hayashi

(10) Patent No.: US 6,591,071 B2
(45) Date of Patent: Jul. 8, 2003

(54) IMAGE FORMING APPARATUS CAPABLE OF CORRECTING CONTROL COEFFICIENT USED TO DETERMINE ELECTRIFICATION BIAS

(75) Inventor: Nobuhiro Hayashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/144,130

(22) Filed: May 14, 2002

(65) Prior Publication Data

US 2002/0172522 A1 Nov. 21, 2002

(30) Foreign Application Priority Data

May 16, 2001 (JP) ..... 2001-146974

(51) Int. Cl.[7] ..... G03G 15/00

(52) U.S. Cl. ..... 399/48; 399/46; 399/50; 399/51

(58) Field of Search ..... 399/48, 46, 50, 399/51

(56) References Cited

U.S. PATENT DOCUMENTS 4,367,948 A * 1/1983 Suzuki ..... 399/48
4,480,909 A * 11/1984 Tsuchiya ..... 399/50
4,502,777 A * 3/1985 Okamoto et al. ..... 399/46
4,610,531 A 9/1986 Hayashi et al.
5,164,771 A * 11/1992 Suzuki et al. ..... 399/46
5,701,551 A * 12/1997 Honda et al. ..... 399/50
2001/0033754 A1 * 10/2001 Asai ..... 399/46

FOREIGN PATENT DOCUMENTS

JP 50-81662 7/1975
JP 57163240 A * 10/1982 ..... G03G/15/02

* cited by examiner

*Primary Examiner*—Sandra Brase
*Assistant Examiner*—Candice C. Campbell
(74) *Attorney, Agent, or Firm*—Fitzpatrick, Cella, Harper & Scinto

(57) ABSTRACT

In a method for forming an image, an electrification device electrifies an image bearing member to a predetermined potential. An exposure device exposes the electrified image bearing member. A potential detection device detects the potential of the electrified image bearing member and the image bearing member is re-electrified using the electrification device in accordance with a value obtained on the basis of the detected potential. The potential of the re-electrified image bearing member is detected. A value to be applied to the electrification device is determined on the basis of both the detected potential and the redetected potential when a difference between the redetected potential and a target value is great. An image is formed by electrifying the image bearing member in accordance with the determined value. The image forming method may be used to expose and then reexpose an electrified image bearing member, wherein re-exposure is performed using a drive value of an exposure device obtained on the basis of a detected potential after electrifying the image bearing member when a difference between the detected potential and a target value is great.

6 Claims, 5 Drawing Sheets

IMAGE FORMING APPARATUS CAPABLE OF CORRECTING CONTROL COEFFICIENT USED TO DETERMINE ELECTRIFICATION BIAS

BACKGROUND OF THE INVENTION

1. Field of the Invention

The present invention relates to an electrophotographic image forming apparatus such as a copying machine or printer.

2. Related Background Art

Conventional image forming apparatuses include an electrophotographic copying machine, laser beam printer, and laser facsimile apparatus.

In the electrophotographic image forming apparatus, the electrification and exposure characteristics of the photosensitive drum vary depending on environmental conditions or changes over time. The image quality must be adjusted by properly adjusting the electrification potential (dark portion potential) by the electrification means and the exposure potential (light portion potential) by the exposure means in activation of the apparatus or before image formation.

Japanese Patent Application Laid-Open No. 50-81662 discloses a simple control method using linear approximation. In the first control executed in activation or prior to image formation after a long idle time, the electrification means is driven by two current values $I_1$ and $I_2$ to measure electrification potentials $V_{D1}$ and $V_{D2}$ of the photosensitive drum at the respective current values. A control coefficient (slope of a straight line I–V) is obtained from these values, and a current value $I_3$ which provides a target potential is calculated based on the control coefficient. In the second control executed prior to image formation after a short idle time, a current value $I_4$ which provides a target potential is easily calculated using the current value $I_3$ and control coefficient obtained in advance.

This control method must perform two or more control operations in the first control even if the electrification and exposure characteristics of the photosensitive drum do not vary. The loss of time undesirably delays the first printing time.

The control method assumes that the current value and electrification potential are linear, and that the characteristics of the photosensitive drum vary linearly.

However, the electrification characteristic (exposure characteristic) does not always vary linearly depending on changes of the photosensitive drum over time or environmental changes. In this case, the validity of the default current values $I_1$ and $I_2$ is low, and an error becomes large between a potential calculated by linear approximation and an actual target potential. Especially in the second control using the previously calculated control coefficient, the reliability of the control coefficient is low. Accordingly, the number of control operations increases, and the convergence precision may decrease.

SUMMARY OF THE INVENTION

It is an object of the present invention to provide an image forming apparatus capable of decreasing the number of electrification potential control operations.

It is another object of the present invention to provide an image forming apparatus capable of obtaining a high-reliability control coefficient.

It is still another object of the present invention to provide an image forming apparatus comprising:

an image bearing member which bears an electrostatic image;

electrification means for electrifying the image bearing member to a predetermined potential;

exposure means for exposing the image bearing member electrified by the electrification means to an image;

potential detection means for detecting a potential of the image bearing member; and determination means for performing calculation using a control coefficient for the potential detected by the potential detection means, and determining an electrification bias value, wherein the determination means corrects the control coefficient to determine an electrification bias when the detected potential upon electrification at the electrification bias obtained by calculation falls outside a predetermined range.

The above object and other objects, features, and advantages of the present invention will be apparent from the following detailed description of the preferred embodiments in conjunction with the accompanying drawings.

DETAILED DESCRIPTION OF THE PREFERRED EMBODIMENTS

Figure 1:
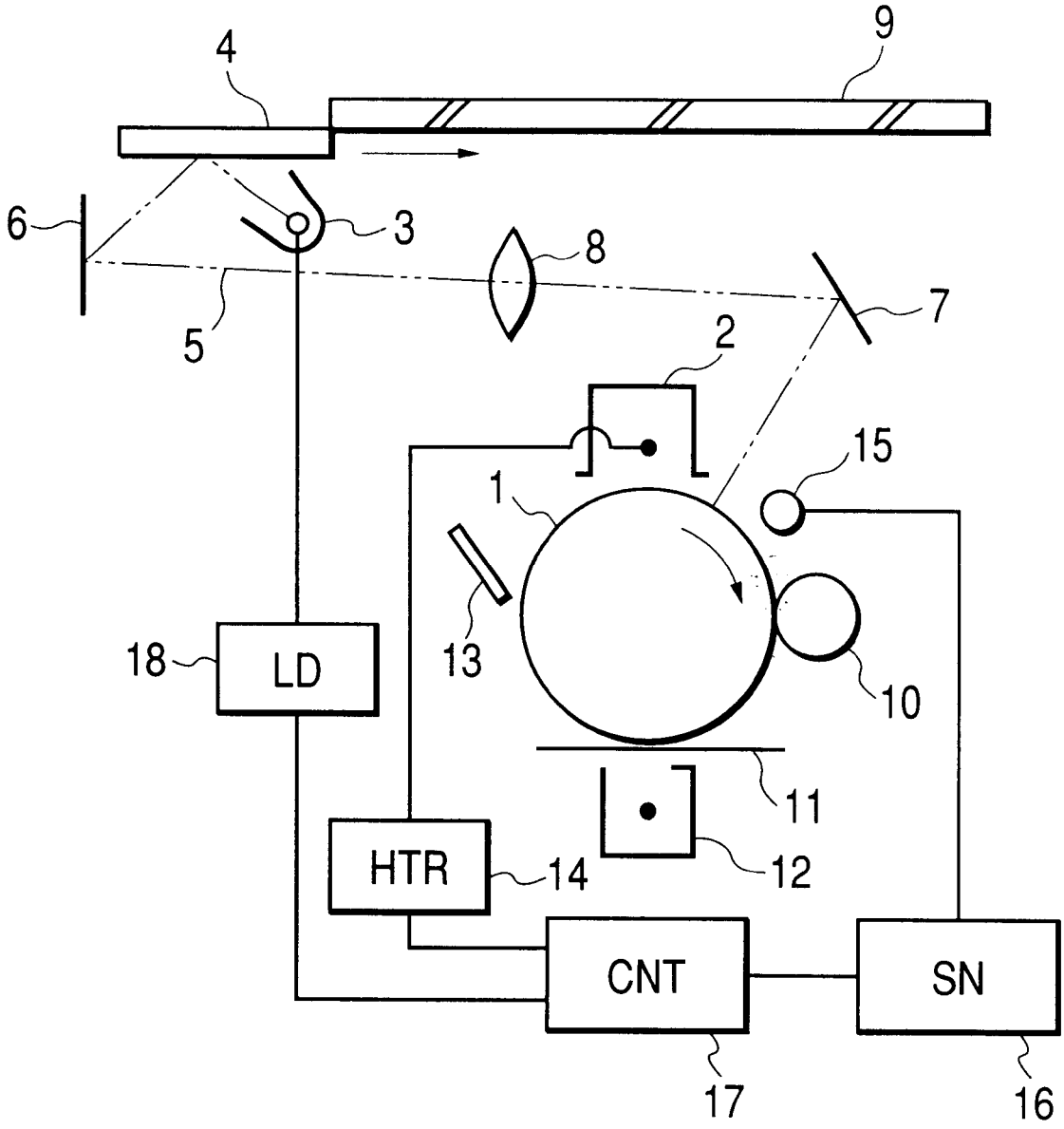
FIG. 1 is a schematic view showing the arrangement of an image forming apparatus according to an embodiment of the present invention.

FIG. 1 is a schematic view showing the arrangement of an image forming apparatus according to an embodiment of the present invention.

As shown in FIG. 1, in the image forming apparatus of the embodiment, an electrification device 2, developing device 10, transfer electrification device 12, and cleaning blade 13 are arranged around a photosensitive drum 1 serving as an image bearing member which bears an electrostatic latent image. An illumination lamp 3, and an optical system (mirror 6, lens 8, and mirror 7) for guiding, as exposure light 5, reflected light of light emitted by the illumination lamp 3 are arranged above the photosensitive drum 1.

The electrification device 2 is an electrification means for receiving a driving current from a high-voltage transformer (HTR) 14 and uniformly electrifying the photosensitive drum 1. This embodiment adopts a corona electrification device for electrifying the photosensitive drum 1 by corona discharge in a noncontact manner.

The illumination lamp 3 receives a driving voltage from a lighting circuit (LD) 18 to irradiate an original set on an original glass 9. Light reflected by the original surface is guided as exposure light onto the photosensitive drum 1 via the optical system made up of the mirrors 6 and 7 and the lens 8, and forms an electrostatic latent image. In this embodiment, the illumination lamp 3 and optical system constitute an exposure means.

The developing device 10 is a developing means for attracting a developer (toner) to the electrostatic latent image formed on the photosensitive drum 1 and visualizing the image. The transfer electrification device 12 is a transfer means for transferring the toner image on the photosensitive drum 1 to a transferring sheet 11.

An image forming operation in the image forming apparatus having the above-described arrangement will now be explained.

When a controller (not shown) generates a copy start signal, the photosensitive drum 1 rotates in a direction indicated by an arrow in FIG. 1. The electrification device 2 uniformly electrifies the surface of the photosensitive drum 1 to a target potential.

While irradiating an original set on the original glass 9, the illumination lamp 3 moves in a direction indicated by an arrow in FIG. 1 together with the mirror 6 to scan the original surface. The light reflected by the original surface is deflected by the mirror 6, converged by the lens 8, and guided as exposure light onto the photosensitive drum 1 by the mirror 7. As a result, the original image is formed on the photosensitive drum 1 to form an electrostatic latent image.

The electrostatic latent image is visualized into a toner image by the developing device 10. The toner image is transferred by the transfer electrification device 12 onto the transferring sheet 11 conveyed in synchronism with the rotation of the photosensitive drum 1. After the cleaning blade 13 removes a residual toner from the photosensitive drum 1, the photosensitive drum 1 is electrified again and continuously repeats the same operation.

The toner image is fixed by a fixing means (not shown), and the transferring sheet 11 bearing the original image (toner image) is discharged outside the apparatus, completing the image forming operation.

An arrangement and control operation concerning potential control in the image forming apparatus of the embodiment will be now described.

As shown in FIG. 1, a potential sensor 15 serving as a potential detection means for detecting the surface potential of the photosensitive drum 1 is arranged near the photosensitive drum 1. The output of the potential sensor 15 is connected to a control circuit (CNT) 17 via a detection circuit (SN) 16.

The control circuit 17 is mainly comprised of a CPU serving as an arithmetic means for performing potential control calculation, a flash memory serving as a storage means which is used as an arithmetic work area or stores a control coefficient and other data, and a ROM which stores a potential control program. The control circuit 17 is connected to the high-voltage transformer 14 of the electrification device 2 and the lighting circuit 18 of the illumination lamp 3. The control circuit 17 is a control means for controlling a driving current output from the high-voltage transformer 14 and a driving voltage applied by the lighting circuit 18, and properly adjusting the electrification potential (dark portion potential) and exposure potential (light portion potential).

Potential control by the control circuit 17 is executed prior to the above-described image forming operation. The control circuit 17 controls the electrification potential (dark portion potential) of the electrification device 2, and after it stabilizes, controls the exposure potential (light portion potential) of the illumination lamp 3.

Figure 2:
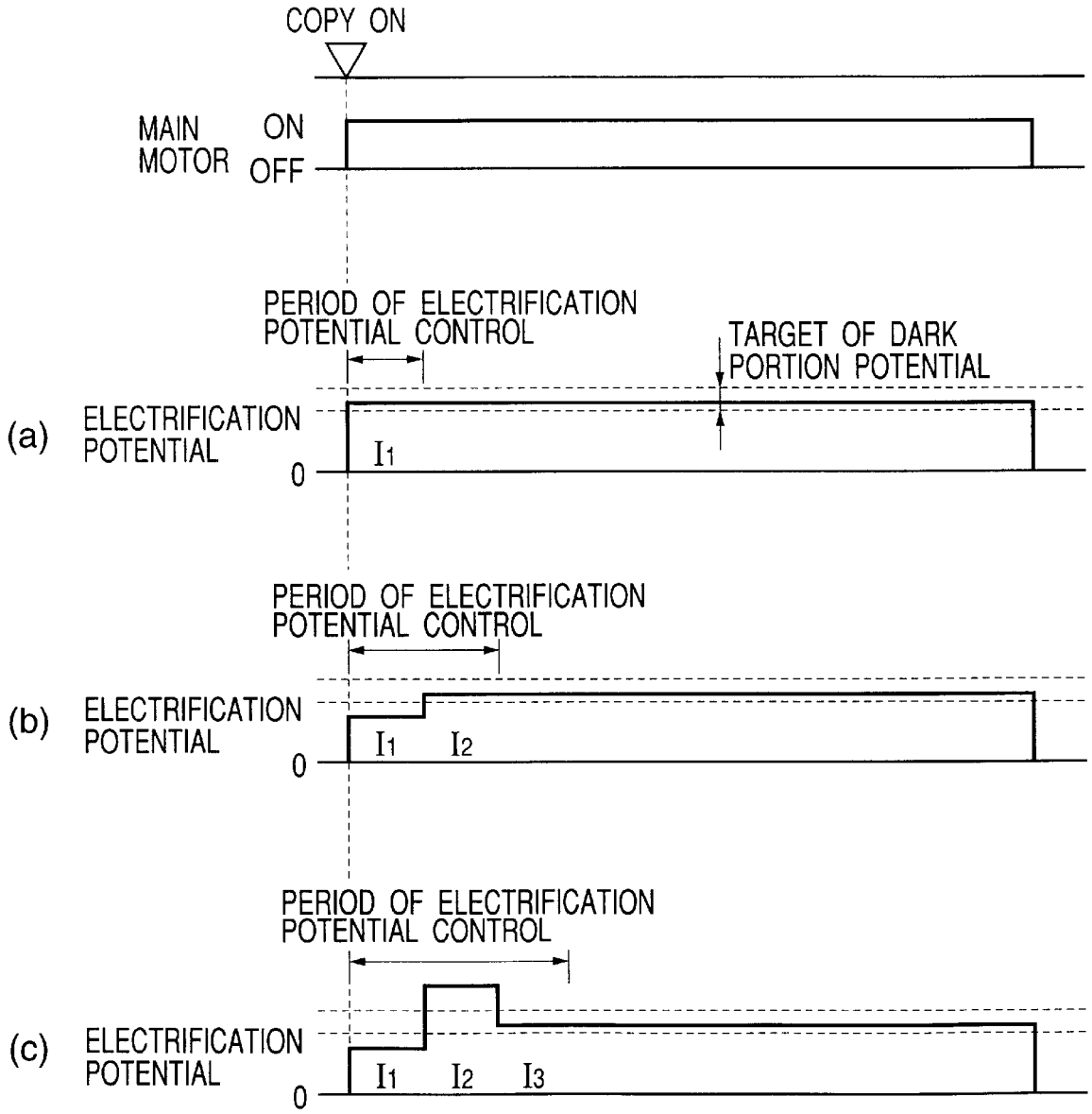
FIG. 2 is timing charts showing an example of electrification potential control operation in the image forming apparatus of FIG. 1.

As shown in FIG. 2, the control circuit 17 turns on the high-voltage transformer 14 simultaneously when a main motor (not shown) for rotating and driving the photosensitive drum 1 and the like is activated. At this time, the control, circuit 17 causes the high-voltage transformer 14 to output a current value $I_1$, [$\mu$A] which has been stored in the flash memory in advance in order to measure the dark portion potential of the photosensitive drum 1 (first control). The photosensitive drum 1 is electrified by the electrification device 2. An electrification potential $V_{D1}$ at this time is detected by the potential sensor 15 and input to the control circuit 17 via the detection circuit 16.

If the detected electrification potential $V_{D1}$ falls within a target $V_{DT}$ of the dark portion potential ±10 [V], as shown in a timing diagram (a) of FIG. 2, the control circuit 17 ends the control, and shifts to exposure potential control. If the electrification potential $V_{D1}$ cannot fall within the target range in the first control, the control circuit 17 executes the second control.

In the second control, the control circuit 17 calculates a new current value $I_2$ by equation (1) using the electrification potential $V_{D1}$ detected in the first control, and the current value $I_1$, and control coefficient $\alpha_1$ which are stored in the flash memory. The control circuit 17 causes the high-voltage transformer 14 to output the current value $I_2$. Then, the photosensitive drum 1 is electrified by the electrification device 2. An electrification potential $V_{D2}$ at this time is detected by the potential sensor 15 and input to the control circuit 17 via the detection circuit 16.

$$I_2=I_1-\alpha_1\times(V_{D1}-V_{D2}) \quad (1)$$

If the detected electrification potential $V_{D2}$ falls within the target $V_{DT}$ of the dark portion potential ±10 [V], as shown in a timing diagram (b) of FIG. 2, the current value $I_2$ is stored instead of the current value $I_1$ stored in the flash memory. The control circuit 17 ends the control, and shifts to exposure potential control. If the electrification potential $V_{D2}$ cannot fall within the target range in the second control, the control circuit 17 executes the third control.

In the third control, the control circuit 17 calculates a new control coefficient $\alpha_2$ by equation (2) using the current value $I_1$ supplied in the first control, the corresponding electrification potential $V_{D1}$, the current value $I_2$ supplied in the second control, and the corresponding electrification potential $V_{D2}$.

$$\alpha_2=(I_2-I_1)/(V_{D2}-V_{D1}) \quad (2)$$

The control circuit 17 calculates a new current value $I_3$ by equation (3) using the new control coefficient $\alpha_2$, the current value $I_2$ in the second control, and the electrification potential $V_{D2}$. The control circuit 17 causes the high-voltage transformer 14 to output the current value $I_3$ (a timing diagram (c) of FIG. 2). The photosensitive drum 1 is electrified by the electrification device 2. An electrification potential $V_{D3}$ at this time is detected by the potential sensor 15 and input to the control circuit 17 via the detection circuit 16.

$$I_3=I_2-\alpha_2\times(V_{D2}-V_{DT}) \quad (3)$$

After the detected electrification potential $V_{D3}$ is confirmed to fall within the target $V_{DT}$ of the dark portion potential ±10 [V], the current value $I_3$ supplied in the third control and the newly calculated control coefficient $\alpha_2$ are stored in place of the current value $I_1$ and control coefficient $\alpha_1$ stored in the flash memory. After that, the control circuit 17 ends the control.

Figure 3:
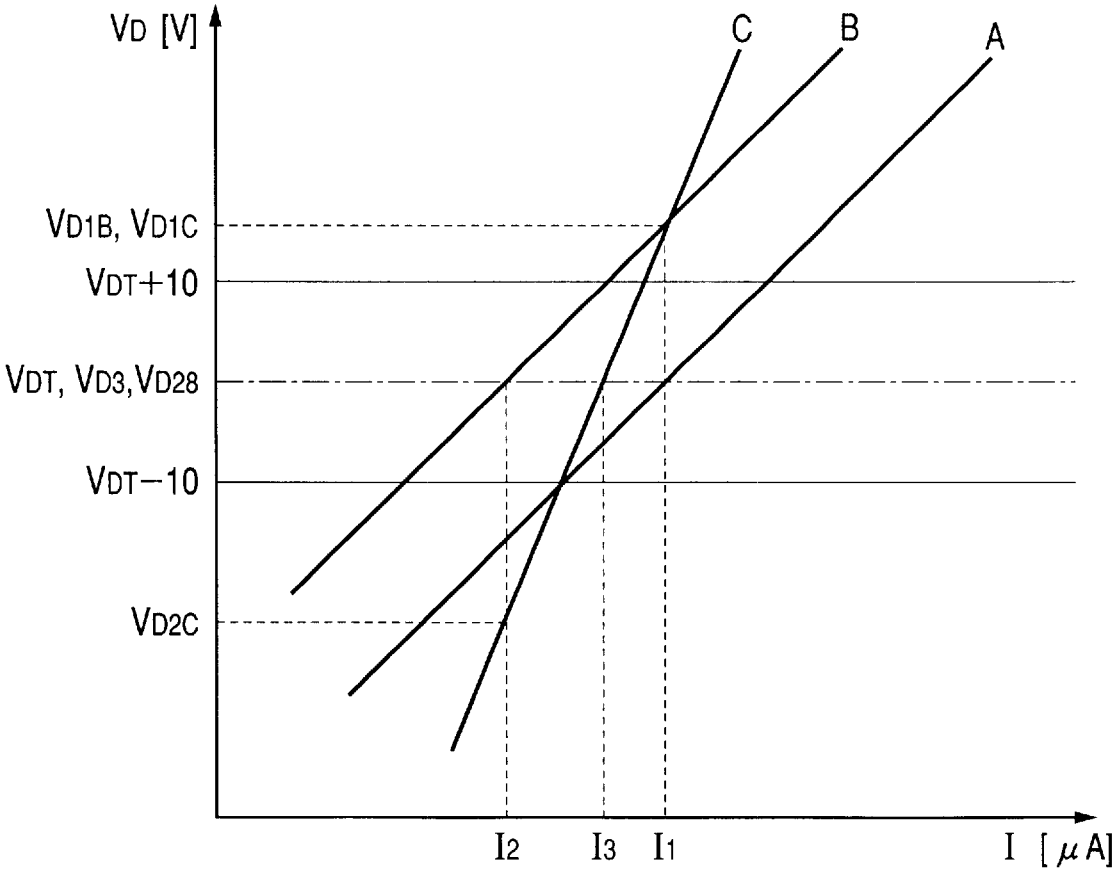
FIG. 3 is a graph showing the relationship between a driving current supplied to an electrification device and the electrification potential of a photosensitive drum.

The significance of the first to third control operations and the respective equations will be additionally explained with reference to the graph of FIG. 3. FIG. 3 is a graph showing the relationship between a driving current supplied to the electrification device and the electrification potential of the photosensitive drum.

Letting $I_1$ be the current value first stored in the flash memory and $\alpha_1$ be control coefficient, the current value $I_1$ is output in the first control to measure the electrification potential $V_{D1}$ of the photosensitive drum. At this time, if the current-potential characteristic does not change from that of the previous control (straight line A is kept unchanged), $V_{D1} \cong V_{DT}$ holds, and the control ends.

If the electrification characteristic of the photosensitive member shifts almost parallel, like a straight line B, an electrification potential $V_{D1B}$ upon electrification at the current value $I_1$ deviates from the range of $V_{DT} \pm 10$ [V]. To prevent this, the current value $I_2$ calculated by equation (1) is output in the second control to measure an electrification potential $V_{D2B}$ of the photosensitive drum. Since the straight line B has almost the same slope as that of the straight line A, $V_{D2B} \cong V_{DT}$ holds. The current value stored in the memory is updated to $I_2$, and the control ends. In the next potential control, the current value $I_2$ is supplied in the first control, and the electrification potential reaches the target potential by one control at high possibility. Note that the control coefficient $\alpha_1$ corresponds to the slope of the straight lines A and B.

The electrification characteristic of the photosensitive member may change its slope, like a straight line C. In this case, the electrification potential is difficult with a large error to converge to the target potential even by using the control coefficient $\alpha_1$. In this case, an electrification potential $V_{D1C}$ upon outputting the current value $I_1$ deviates from the range of $V_{DT} \pm 10$ [V], as shown in FIG. 3. An electrification potential $V_{D2C}$ upon outputting the current value $I_2$ calculated by equation (1) in the second control also deviates from the range of $V_{DT} \pm 10$ [V].

In this case, the third control is executed. First, a new control coefficient $\alpha_2$ is calculated by equation (2). Then, a new current value $I_3$ is calculated using the control coefficient $\alpha_2$, and the electrification potential $V_{D3}$ of the photosensitive drum upon outputting the current value $I_3$ is measured. Since the control coefficient $\alpha_2$ corresponds to the slope of the straight line C, $V_{D3} \cong V_{DT}$ holds. The calculated control coefficient $\alpha_2$ and current value $I_3$ are stored in the flash memory instead of the control coefficient $\alpha_1$ and current value $I_1$, and the control ends.

Figure 4:
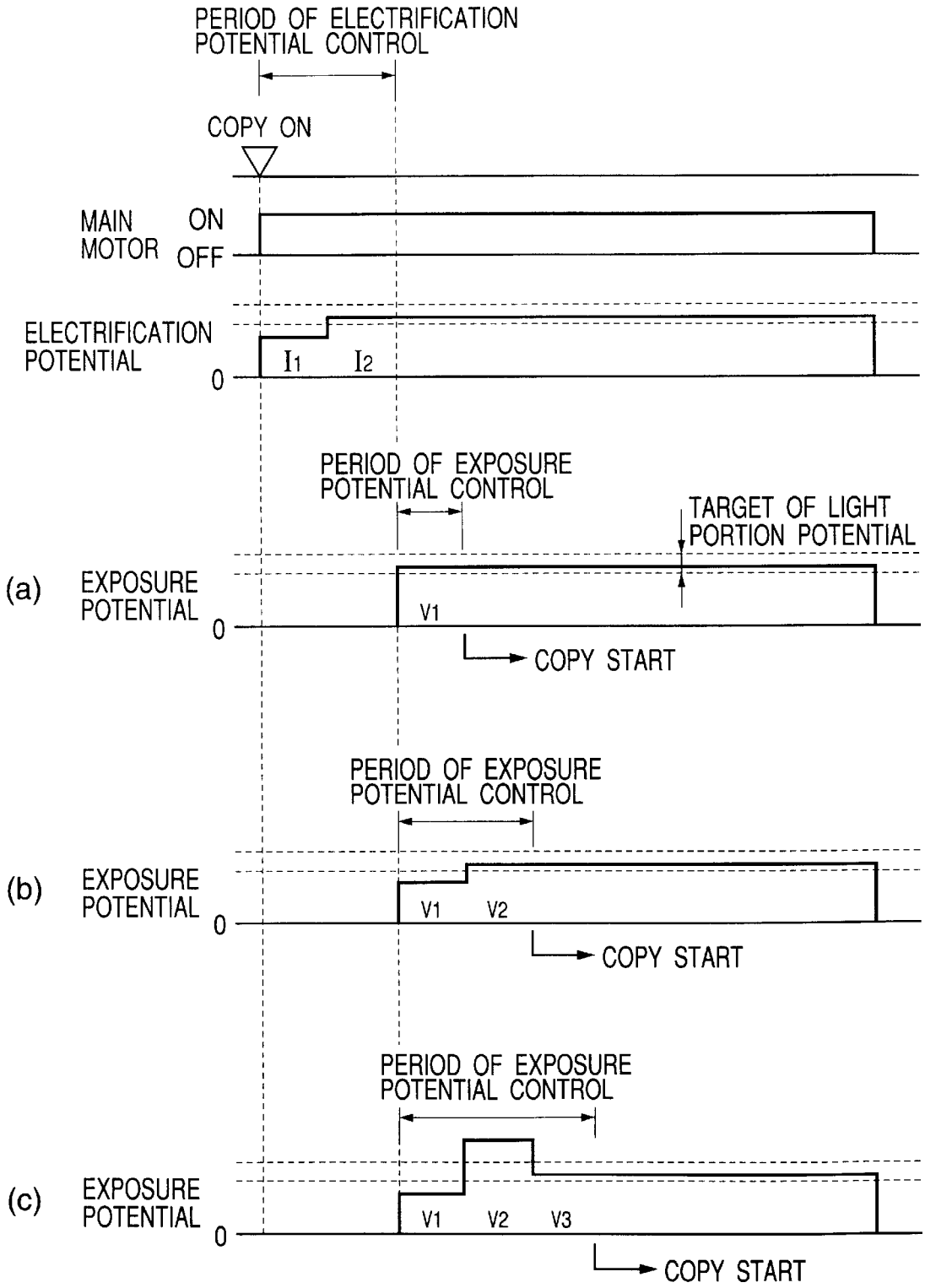
FIG. 4 are timing charts showing an example of an exposure potential control operation in the image forming apparatus of FIG. 1.

After control of the electrification potential (dark portion potential) ends, control of the exposure potential (light portion potential) starts. FIG. 4 are timing charts showing examples of potential control operation of the exposure potential.

After the photosensitive drum 1 is electrified to the electrification potential $V_{DT}$ by the current value $I_2$ determined by the above-mentioned electrification potential control, the control circuit 17 turns on the lighting circuit 18. The control circuit 17 turns on the illumination lamp 3 at an ON voltage $v_1$ [V] stored in advance in the internal memory (storage means) of the lighting circuit 18. Illumination light from the illumination lamp 3 is reflected by a standard white plate 4 attached aside the original glass 9. The reflected light is incident as exposure light on the photosensitive drum 1 via the optical system. The surface potential of the photosensitive drum 1 after exposure is detected by the potential sensor 15, and input to the control circuit 17 via the detection circuit 16.

If the detected exposure potential $V_{L1}$ falls within a target $V_{LT}$ of the light portion potential ±10 [V], as shown in a timing diagram (a) of FIG. 4, the control circuit 17 ends the potential control on the stage of the first control, and starts copying (image forming operation).

If the exposure potential $V_{L1}$ does not fall within the target $V_{LT}$ of the light portion potential ±10 [V], the second and third exposure potential control operations are executed, similar to electrification potential control. Equations used in exposure potential control are as follows:

$$v_2 = v_1 + \beta_1 \times (V_{L1} - V_{LT}) \quad (4)$$

$$\beta_2 = (v_2 - v_1)/(V_{L2} - V_{L1}) \quad (5)$$

$$v_3 = v_2 + \beta_2 \times (V_{L2} - V_{LT}) \quad (6)$$

Equations (4) to (6) concerning exposure potential control correspond to equations (1) to (3) concerning electrification potential control. Exposure potential control is different from electrification potential control in that the lamp ON voltage v and control coefficient $\beta$ replace the current value I and control coefficient $\alpha$.

Figure 5:
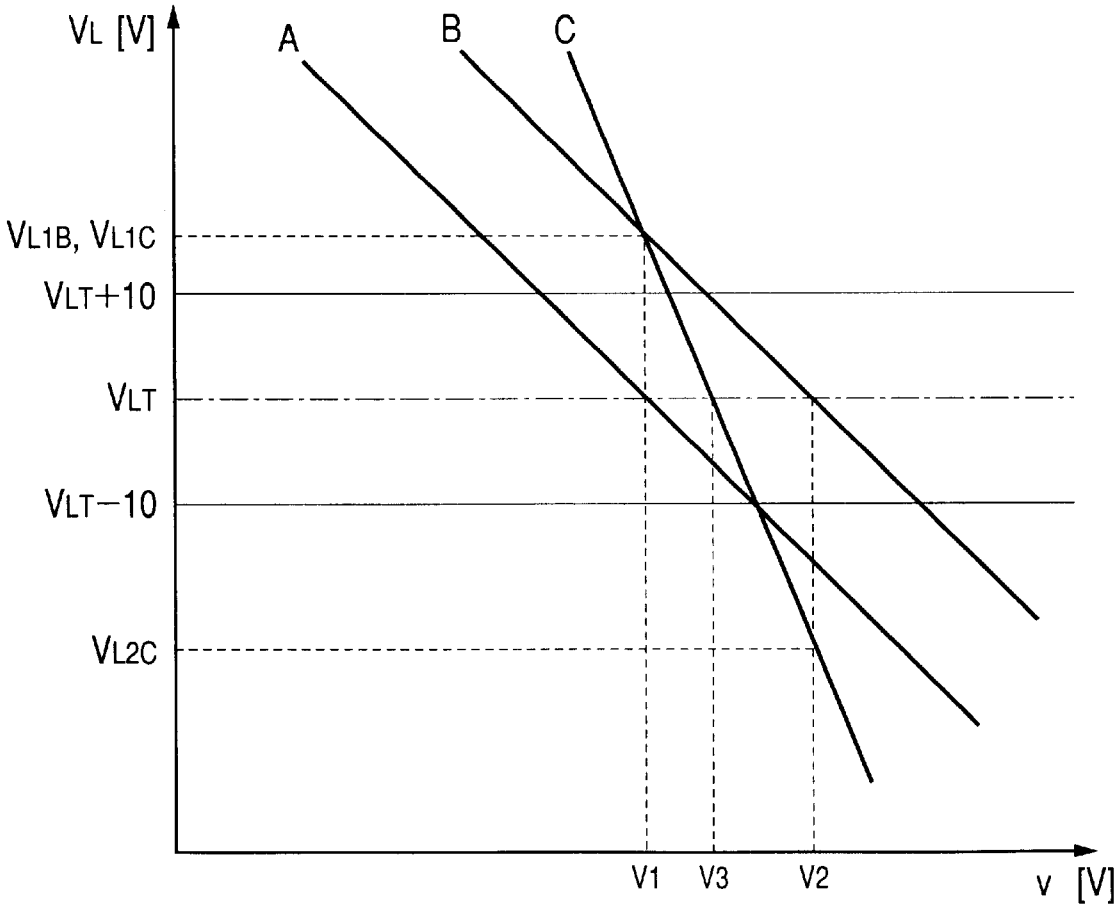
FIG. 5 is a graph showing the relationship between a driving voltage applied to an illumination lamp and the exposure potential of the photosensitive drum.

Also in control of the exposure potential (light portion potential), the first control is performed using the ON voltage $v_1$ stored in the memory, as shown in the graph of FIG. 5. If the target of the light portion potential cannot be attained (straight line B or C is kept unchanged), the second control of calculating a new ON voltage $v_2$ on the basis of equation (4) and performing exposure is executed. If the target of the light portion potential cannot be obtained even by the second control (straight line C is kept unchanged), a new control coefficient $\beta_2$ is calculated by equation (5), and an ON voltage $v_3$ is calculated by equation (6) using the control coefficient $\beta_2$ (third control)

If the exposure potential reaches the target of the light portion potential, an ON voltage and control coefficient at this time are stored in the memory, similar to electrification potential control. The ON voltage v and control coefficient $\beta$ are stored in the internal memory of the lighting circuit 18 in this embodiment, but may be stored in the flash memory of the control circuit 17.

As has been described above, according to the embodiment, a control operation is performed using the current value $I_1$ and voltage value $v_1$ stored in the memory in the first control. Control is completed by one operation when the electrification and exposure characteristics of the photosensitive drum 1 hardly vary. Accordingly, an image forming operation can start as soon as possible.

If the characteristics greatly vary and the potential does not converge to a target potential by one control, the second control is executed using the control coefficients $\alpha_1$ and $\beta_1$ stored in the memory. For linear variations in the characteristics of the photosensitive drum 1, the target potential can be obtained by the second control. An obtained current value and voltage value are stored in the memory, which enables exploiting them in the first control in the next potential control. The potential can reach the target potential by one control with a high possibility.

If the potential does not converge to the target potential even by the second control, a new control coefficient is calculated from the first and second measurement values to perform the third control, and the new control coefficient is stored in the memory. The control coefficient can be corrected to converge the potential to the target potential with high precision even upon nonlinear variations in the characteristics of the photosensitive drum 1 owing to changes of the photosensitive drum 1 over time or changes in the installation location (environment) of the apparatus main body.

In this way, the number of control operations is adaptively changed in accordance with changes in the characteristics of the photosensitive drum 1. Control results are fed back to update the control coefficient, current value, and voltage value stored in the memory at any time. High-reliability latent image potential control can be quickly achieved under any conditions, and a short first printing time and high image quality can be realized.

The above embodiment employs a corona electrification device as an electrification means, and an illumination lamp as an exposure means. The present invention is not limited to this arrangement, and can provide the same effects as those described above even with another arrangement using another means such as a roller electrification device as an electrification means and a laser exposure device as an exposure means (when image exposure is done using a laser, dark and light portion potentials are opposite from those in the embodiment).

The above embodiment adopts a sequence of controlling the potential every copying. For a stable-potential system, the potential need not be controlled every time. The standby time in control is desirably minimized by selecting the control timing in accordance with the arrangement or operation of each apparatus, such as every predetermined time, every predetermined number of copies, every predetermined idle time, or every main switch ON operation.

In the above embodiment, the driving current is adjusted in controlling the electrification potential, and the driving voltage is controlled in controlling the exposure potential. The current and voltage are not limited to them. A driving voltage applied to the electrification means may be controlled, or a driving current supplied to the exposure means may be adjusted. Also in this case, the same control as that in the embodiment can be achieved.

The embodiments of the present invention have been described above. The present invention is not limited to these embodiments, and can be variously modified within the spirit and scope of the present invention.

What is claimed is:

1. An image forming method comprising the steps of:

electrifying an image bearing member using an electrification means;

detecting a potential of the image bearing member electrified using the electrification means;

re-electrifying the image bearing member using the electrification means in accordance with a value obtained on the basis of the detected potential;

redetecting a potential of the re-electrified image bearing member;

determining the value to be applied to the electrification means on the basis of both the previously detected potential and the redetected potential when a difference between the redetected potential and a target value is great; and forming an image by electrifying the image bearing member in accordance with the determined value.

2. An image forming method according to claim 1, wherein the determined drive value to be applied to the electrification means is obtained by performing a calculation using a stored control coefficient.

3. An image forming method according to claim 2, wherein when the difference between the detected original potential and the target value is great, the stored control coefficient is corrected and a corrected control coefficient is stored in a storage means to be used as the stored control coefficient.

4. An image forming method comprising the steps of:

electrifying an image bearing member using an electrification means;

exposing the electrified image bearing member using an exposure means;

detecting a potential of the image bearing member exposed using the exposure means;

re-exposing the image bearing member using the exposure means in accordance with a drive value obtained on the basis of the detected potential after electrifying the image bearing member when a difference between the detected potential and a target value is great;

redetecting a potential of the re-exposed image bearing member;

determining the drive value of the exposure means on the basis of both the previously detected potential and the redetected potential when a difference between the redetected potential and the target value is great; and forming an image by exposing the image bearing member in accordance with the determined drive value.

5. An image forming method according to claim 4, wherein the determined drive value of the exposure means is determined by performing a calculation using a stored control coefficient.

6. An image forming method according to claim 5, wherein when the difference between the detected original potential and the target value is great the stored control coefficient is corrected and a current corrected control coefficient is stored in a storage means to be used as the stored control coefficient.

* * * * *

UNITED STATES PATENT AND TRADEMARK OFFICE

CERTIFICATE OF CORRECTION

PATENT NO. : 6,591,071 B2
DATED : July 8, 2003
INVENTOR(S) : Nobuhiro Hayashi

It is certified that error appears in the above-identified patent and that said Letters Patent is hereby corrected as shown below:

Title page,
Item [56], FOREIGN PATENT DOCUMENTS,
"JP 57163240 A" should read -- JP 57-153240 A --.
Item [57], ABSTRACT,
Line 16, "reexpose" should read -- re-expose --.

Column 2,
Line 35, "are" should read -- is --.

Column 5,
Line 51, "are" should read -- is --.

Column 8,
Line 44, "great" should read -- great, --.

Signed and Sealed this

Thirtieth Day of December, 2003

JAMES E. ROGAN
*Director of the United States Patent and Trademark Office*